US005490408A

United States Patent [19]

Ando et al.

[11] Patent Number: 5,490,408

[45] Date of Patent: Feb. 13, 1996

[54] METHOD OF AND APPARATUS FOR EXTRUDING A BILLET OF A LIGHT METAL ALLOY

[75] Inventors: Shoichi Ando; Yoshihisa Doi; Makoto Otsubo, all of Saitama, Japan

[73] Assignee: Honda Giken Kogyo Kabushiki Kaisha, Tokyo, Japan

[21] Appl. No.: 360,573

[22] Filed: Dec. 21, 1994

[30] Foreign Application Priority Data

Dec. 27, 1993 [JP] Japan ..... 5-348602

[51] Int. Cl.[6] ..... B21C 23/00; B21C 3/00

[52] U.S. Cl. ..... 72/256; 72/253.1; 72/467

[58] Field of Search ..... 72/253.1, 256, 72/269, 272, 467

[56] References Cited

U.S. PATENT DOCUMENTS

| | | | |
|---|---|---|---|
| 3,983,731 | 10/1976 | Sundmar | 72/467 |
| 3,999,415 | 12/1976 | Austen | 72/253.1 |
| 4,550,584 | 11/1985 | Degen | 72/273 |
| 4,773,251 | 9/1988 | Kohnhauser | 72/467 |
| 4,829,802 | 5/1989 | Baumann | 72/272 |

FOREIGN PATENT DOCUMENTS

| | | |
|---|---|---|
| 577318 | 1/1982 | Japan . |
| 459147 | 2/1992 | Japan . |
| 4305311 | 10/1992 | Japan . |

*Primary Examiner*—Lowell A. Larson
*Assistant Examiner*—Rodney Butler
*Attorney, Agent, or Firm*—Weiner, Carrier & Burt; Joseph P. Carrier; Irving M. Weiner

[57] ABSTRACT

A method of, and an apparatus for extruding a billet of a light metal alloy, wherein the billet has an outer diameter smaller than a maximum configuration width and larger than a minimum configuration width of the die hole at its entry side. The billet is pressurized and extruded by a stem to form a preshaped portion which is larger than the entry side configuration of the die hole, at a frontal end portion of the billet near an entry portion of the die hole. The preshaped portion of the billet is subsequently shaped by the die hole into an extruded shape corresponding to the cross-sectional shape of the die hole and of parts formed from the extruded billet, e.g., of an automobile suspension arm. A reduced resistance and a minimized extrusion pressure upon extrusion of a light metal alloy result from the preshaping of the billet and enable realization of a compact and less expensive arrangement of the production facility.

18 Claims, 2 Drawing Sheets

METHOD OF AND APPARATUS FOR EXTRUDING A BILLET OF A LIGHT METAL ALLOY

BACKGROUND OF THE INVENTION

1. Field of the Invention

The present invention relates to a method of and an apparatus for extruding a billet of a light metal alloy. Specifically, the invention pertains to a method and an apparatus wherein a billet of a light metal alloy can be extruded with a reduced resistance and shaped into a desired configuration of a product under a low extruding force.

2. Description of the Related Art

Heretofore, various methods are known for extruding light metal alloy, such as those disclosed in the following patent documents: U.S. Pat. Nos. 4,550,584, 4,773,251 4,829,802, JP-A-57-7,318, JP-A-4-59,174, JP-A-4-305,311, etc.

Among other things, JP-A-4-59,174 discloses a method wherein light metal alloy is extruded and shaped into a connecting rod. More particularly, a raw material in the form of a billet to be processed, comprising a light metal alloy, is formed into a rod-like body by means of an extrusion die having a die hole which is similar in the outer configuration to a connecting rod, and the so-obtained rod-like body is cut into billets of a predetermined length which are then shaped by a forging die into the connecting rods.

However, there have been such problems with the above-mentioned extrusion method that the raw material billet has an outer diameter which is greater than the maximum configuration width of the die hole of the die and hence an increased cross-sectional area. Due to such problems the extrusion cannot be performed without an increased extrusion pressure to achieve a required load per unit area for the extrusion.

SUMMARY OF THE INVENTION

According to one aspect of the present invention, there is provided a method of extruding a billet of a light metal alloy from a die hole in a die, which comprises the steps of preshaping by use of a pushing stem a billet having an outer diameter which is smaller than a maximum width and larger than a minimum width of an entry side configuration of the die hole, thereby forming a frontal end portion of the billet into a preshaped portion which is larger than the entry side configuration of the die hole near the entry portion of the die hole, and subsequently extruding the preshaped portion by the die hole into an extruded shape.

According to another aspect of the present invention, there is provided an apparatus for extruding a billet of a light metal alloy, comprising a first die having a die hole shaped substantially the same as a desired extruded shape of the billet, a second die disposed on an upstream side of the first die and having a preshaping hole of a shape which is larger than the extruded shape, a container disposed on an upstream side of the second die, for accommodating a billet having an outer diameter which is smaller than a maximum width of said extruded shape, and a stem for extruding and pressurizing the billet within the container.

According to the present invention, there is used a billet having an outer diameter which is smaller than the maximum width and larger than the minimum width of the entry side configuration of the die hole in the first die. The billet is initially opposed to the die hole in the first die such that a preshaped portion is formed by and within the die hole in the second die on the upstream side of the first die. The billet is subsequently shaped into the extruded shape by the die hole in the first die on the downstream side.

The billet has a reduced cross-sectional area because its outer diameter is smaller than the maximum width of the entry side configuration of the die hole in the first die. Thus, it is possible to reduce the extrusion pressure required for achieving a unit load for the extrusion by the die hole in the first die. As a result, it is possible to realize a compact arrangement of the production facility which is less expensive and advantageous in term of its cost. These advantages are achieved by the present invention with a simple constitution by making an outer diameter of the billet smaller than the maximum width of the entry side configuration of the die hole in the first die, and arranging, on the upstream side of the first die, a second die having a preshaping die hole.

BRIEF DESCRIPTION OF THE DRAWINGS

FIGS. 4 to 8 show the successive production steps of the extrusion method according to the preferred embodiment of the present invention, wherein: FIG. 4 is a longitudinal-sectional view showing a state in which a billet is supplied to and set within a container;

FIG. 5 is a longitudinal-sectional view showing a state in which the billet is pressurized and formed with a preshaped portion on its frontal end;

FIG. 6 is a longitudinal-sectional view showing a state in which the billet is further pressurized and formed with an extruded shaped portion;

FIG. 7 is a longitudinal-sectional view showing a state in which the container and the die are separated from each other to remove the shaped portion of the billet and cut away the metal dead zones at the frontal end of the shaped portion of the billet and the metal dead zone at the distal end of the preshaped portion of the billet within the die hole; and FIG. 8 is a longitudinal-sectional view showing a state in which a new billet is supplied to perform a new extrusion process.

DETAILED DESCRIPTION OF THE PREFERRED EMBODIMENT

One preferred embodiment of the extrusion method and apparatus according to the present invention will be explained below with reference to the accompanying drawings.

The extruding apparatus according to the present invention is constructed for processing, for example, automobile suspension arms, and comprised of a two-stage die assembly which includes a first die 1 and a second die 2.

Figure 4:
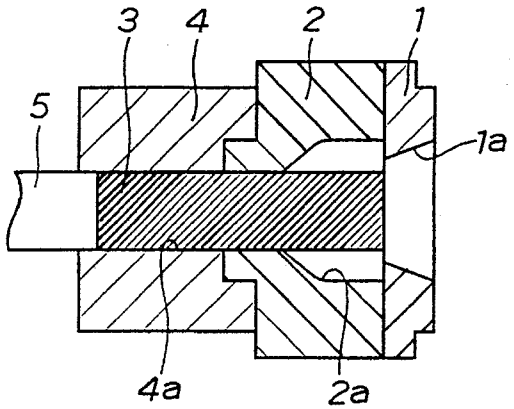

On the upstream side of the second die 2, for accommodating a cylindrical billet 3, there is arranged a container 4 having a cylindrical bore **4*a* in which the billet 3 is fitted. A stem 5 is axially slidably arranged in the cylindrical bore 4*a* for extruding the billet 3 which has been fitted within the cylindrical bore 4*a*. The upstream end surface of the second die 2 is provided with a projection 2b, and the downstream end surface of the container 4 is formed with a recess 4b which can be fitted with the projection 2b to axially detachably couple the container 4 and the second die 2. During the extrusion, the first and second dies 1 and 2 and the container 4 are coupled to each other, as shown in FIG. 4**.

Figure 3:
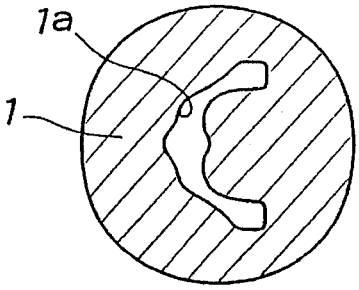
FIG. 3 is a cross-sectional view taken along the line 3—3 in FIG. 1.

The first die 1 is provided, as shown in FIG. 3, with a die hole 1a. The die hole 1a has a configuration which is one size larger than the outer configuration of an automobile suspension arm, for example, and is slightly tapered so that the diameter increases from the entry side (upstream side) to the exit side (frontal end side of the die 1). The die hole 1a in the illustrated embodiment has a cross-sectional configuration of the suspension arm which, as shown in FIG. 3, is substantially C-shaped.

Figure 1:
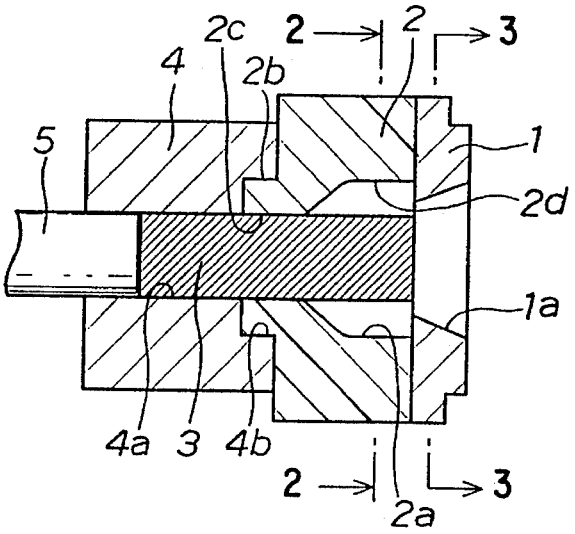
FIG. 1 is a longitudinal-sectional view of the extrusion apparatus according to preferred embodiment of the present invention.
Figure 2:
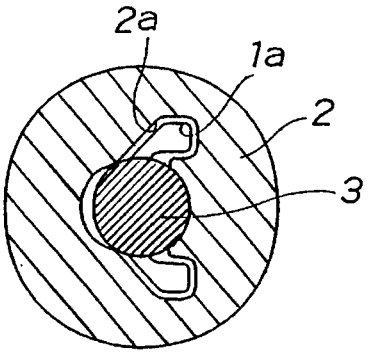
FIG. 2 is a cross-sectional view taken along the line 2—2 in FIG. 1.

On the other hand, the second die 2 is provided, as shown in FIG. 2, with a preshaping hole 2a having an exit side opposed to the first die 1, which is one size greater than the above-mentioned die hole 1a in the first die 1. The preshaping hole 2a has an entry side opposed to the container 4, having a shape which is substantially the same as the cylindrical bore 4a of the container 4 so as to guide the billet 3 when it is supplied to the die assembly.

The preshaping hole 2a has a cross-sectional shape which gradually changes from a circular shape on the entry side to the substantially C-shape on the exit side 2d.

The cylindrical bore 4a of the container 4 has an inner diameter which substantially coincides with an outer diameter of the billet 3 and the outer diameter of the stem 5 so that the billet 3 and the stem 5 can be tightly fitted and axially slidable within the cylindrical bore 4a.

The billet 3 has a diameter which is smaller than the maximum width (for example, the diameter of the circumscribed circle) of the die hole 1a in the first die 1 and greater than the minimum width (for example, the diameter of the inscribed circle) of the die hole 1a. Thus, when the billet 3 is forced toward the entry portion of the first die 1, at least part of the end surface of the billet 3 abuts against at least part of the end surface of the first die 1.

The extrusion method with the above-mentioned apparatus will be explained below with reference to FIGS. 4 to 8.

Although not shown, prior to the initial step of FIG. 4 the stem 5 is retracted and spaced from the upstream side of the container 4. Then, as shown in FIG. 4, a heated billet 3 is inserted and set into the cylindrical bore 4a of the container 4. The stem 5 is subsequently advanced and fitted within the cylindrical bore 4a to urge the billet 3 toward the die 1. FIG. 4 shows a state in which the front end portion of the billet 3 is situated within the die hole 2a in the second die 2, with the front end surface of the billet 3 in abutment with the rear end surface on the entry side of the die hole 1a in the first die 1.

Figure 5:
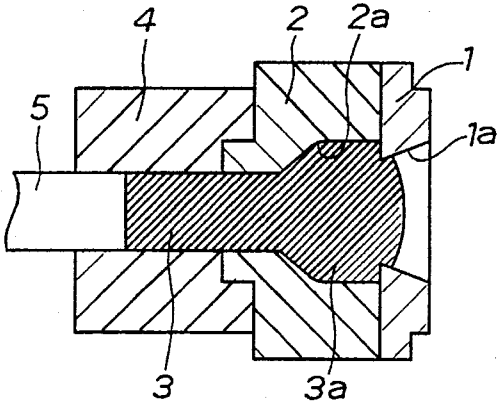

A continued application of the pressure by means of the stem 5 causes the billet 3 to be urged toward the first die 1. Since at least part of the front end surface of the billet 3 is in abutment with the entry surface of the first die 1, the axial movement of the billet 3 is restricted. As a result, as shown in FIG. 5, the front end portion of the billet 3 undergoes a widthwise increase in the die hole 2a of the second die 2 in conformity with the die hole 2a, to eventually form a preshaped portion 3a which conforms with the die hole 2a in the second die 2 as a preshaping hole. Such a state is shown in FIG. 5.

Figure 6:
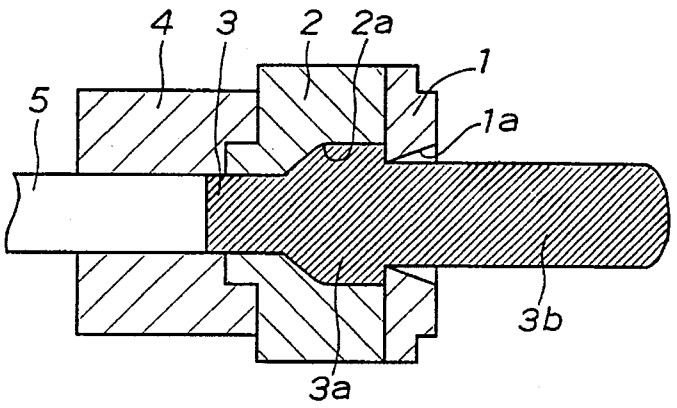

Subsequent application of a pressure by the stem 5 causes the above-mentioned preshaped portion 3a of the billet 3 to be forced into the die hole 1a in the first die 1 and shaped into conformity with the die hole 1a. The billet 3 is further axially extruded out of the die hole 1a of the first die 1 to form an extruded shaped portion 3b. Such a state is shown in FIG. 6.

In this instance, the pressure to be applied to the billet 3 by the stem 5 is significantly reduced as compared to a case wherein use is made of a billet having an initial cross-sectional area which covers the entire die hole 1a (for example, the diameter which is greater than the circumscribed circle).

Figure 7:
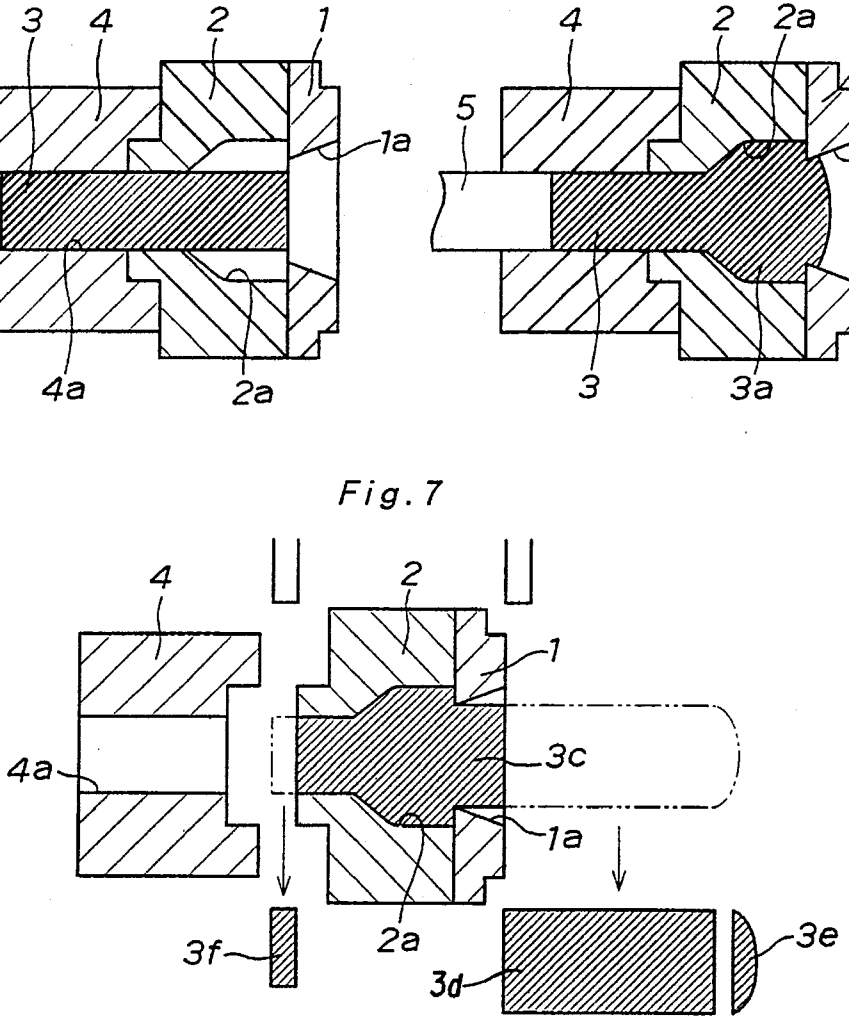

After completion of the extrusion, as shown in FIG. 7, the container 4 is separated from the die assembly formed of the first and second dies 1 and 2, to cut away the shaped portion 3b of the billet 3 extruded out of the first die 1 leaving the billet portion 3c within the die holes 1a, 2a. The shaped portion 3d of the billet 3 as cut away has a metal dead zone 3e on its front end which is then removed. The residual billet portion 3c left within the die holes 1a, 2a has a metal dead zone 3f on its proximal end, which is also removed. Such a state is shown in FIG. 7. For purposes of economy and efficiency in using the material, the removed metal dead zones 3e, 3f are melted and used again.

Figure 8:
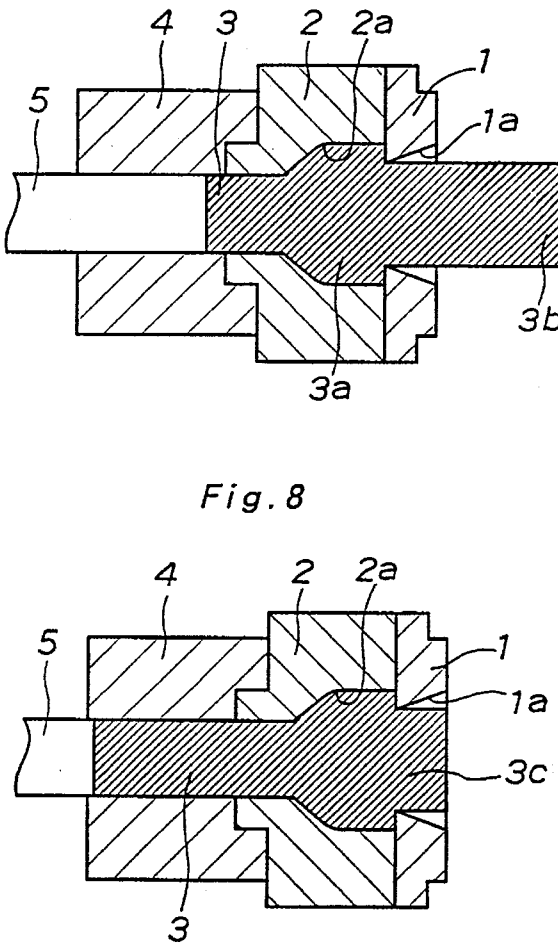

Subsequently, the die assembly 1, 2 is coupled to the container 4 once again and a new billet 31 is supplied to and inserted into the cylindrical bore 4a in the container 4. By axially advancing the new billet, the residual billet portion 3c left within the die holes 1a, 2a is extruded and shaped into the desired cross-section. FIG. 8 shows a state immediately before a renewed extrusion.

Incidentally, the extruded shaped portion 3d removed away as shown in FIG. 7 is cut into slices which are respectively shaped into suspension arms after trimmings or the like, if necessary.

It will be appreciated from the foregoing that, with the method and apparatus for extruding a billet of a light metal alloy according to the present invention, there is used a billet having an outer diameter which is smaller than the maximum width of the entry configuration of the die hole, such that a wider preshaped portion is formed in the vicinity of the die hole entry portion and the extruded shape is subsequently formed. In this way, it is possible to reduce the cross-sectional area of the billet and lower the extrusion pressure. Consequently, it is possible to realize a compact and less expensive arrangement of the production facility. It should be noted that these advantages can be achieved with a simple constitution by using a billet with an outer diameter which is smaller than the maximum width of the entry side configuration of the die hole in the first die, and arranging, on the upstream side of the first die, a second die having a preshaping die hole as discussed above. Although there has been described what is at present considered to be the preferred embodiment of the invention, it will be understood, of course, that the invention can be embodied in other specific forms without departing from the spirit or scope thereof. It will also be understood that the words used are words of description rather than limitation, and that various changes may be made without departing from the spirit of the disclosed invention. The scope of the invention is indicated by the appended claims, rather than by the foregoing description.

We claim:

1. A method of extruding a billet of a light metal alloy from a die hole in a die, comprising the steps of preshaping, by use of a pushing stem, a billet having an outer diameter which is smaller than a maximum width of an entry side configuration of the die hole, thereby forming a frontal end portion of the billet into a preshaped portion which is larger than said entry side configuration, near an entry portion of the die hole, and subsequently extruding the preshaped portion by said die hole into an extruded shape.

2. The method according to claim 1, wherein said billet is heated.

3. The method according to claim 1, wherein said billet is forced by said stem through a cylindrical hole of a container, before formation of said preshaped portion, and pressurized so that the formation of said preshaped portion takes place continuously with the shaping of the billet into said extruded shape.

4. The method according to claim 1, further comprising the steps of cutting a downstream side of a shaped portion of said billet extruded axially forward of said die hole during said extruding step, separating the shaped portion from the die, and removing a downstream side metal dead zone at a frontal end portion of the shaped portion to form an extruded member to be further processed.

5. The method according to claim 1, wherein said outer diameter of said billet is larger than a minimum width of the die hole, and said billet has an end surface which is brought into abutment with at least part of an entry side surface of said die when said frontal portion of said billet is formed into said preshaped portion.

6. The method according to claim 1, wherein said die hole is substantially C-shaped.

7. The method according to claim 4, wherein said shaped portion of the billet has an upstream side remaining in said die hole and having a proximal end region which is cut away and removed as an upstream side metal dead zone when said downstream side of the billet is separated from the die.

8. An apparatus for extruding a billet of a light metal alloy, comprising:

a first die having a die hole shaped substantially the same as a desired extruded shape of a billet;

a second die disposed on an upstream side of the first die and having a preshaping hole of a shape which is larger than said extruded shape;

a container disposed on an upstream side of the second die, for accommodating a billet having an outer diameter which is smaller than a maximum width of said extruded shape; and a stem for extruding and pressurizing the billet within said container.

9. The apparatus according to claim 8, wherein said container includes a cylindrical hole having an inner diameter which is substantially the same as said outer diameter of the billet and an outer diameter of said stem.

10. The apparatus according to claim 8, wherein said container has a cylindrical hole defined therein having an inner diameter which is substantially the same as said outer diameter of the billet and an outer diameter of said stem, and said stem urges said billet toward the dies for thereby forming said billet into said extruded shape.

11. The apparatus according to claim 8, wherein said die hole of said first die is substantially C-shaped.

12. A method of extruding a billet of a light metal alloy from a die hole in a die, comprising the steps of:

providing die means including first and second die openings for extruding a billet therethrough, said second die opening being disposed upstream of said first die opening, and said second die opening being shaped substantially similar to and larger than a shape of said first die opening;

providing a billet having an outer dimension which is smaller than a maximum width of said first die opening and larger than a minimum width of said first die opening;

forcing said billet against an upstream side of a die surface surrounding said first die opening so that a frontal portion of said billet is preshaped within said second die opening; and extruding said preshaped frontal portion of said billet through said first die opening.

13. The method according to claim 12, wherein an upstream end of said second die opening is shaped substantially similar to an original cross-sectional shape of said billet, and a downstream end of said second die opening is shaped substantially similar to and larger than the shape of said first die opening.

14. The method according to claim 12, wherein said forcing and extruding steps are performed concurrently on different portions of said billet.

15. The method according to claim 13, wherein said second die opening includes an intermediate portion which gradually changes shape from the shape at said upstream end of the second die opening to the shape at the downstream end of said second die opening.

16. An apparatus for extruding a billet of a light metal alloy, comprising:

die means including first and second die openings disposed adjacent to each other for extruding a billet of a light metal alloy therethrough;

said first die opening having a maximum width which is larger than an outer dimension of a billet to be extruded therethrough and a minimum width which is smaller than the outer dimension of the billet;

said second die opening is disposed upstream of said first die opening relative to a billet processing operation;

said second die opening being shaped substantially similar to and larger than a shape of said first die opening; and stem means for forcing the billet through said first and second die openings.

17. The apparatus according to claim 16, wherein an upstream end of said second die opening is shaped substantially similar to an original cross-sectional shape of said billet, and a downstream end of said second die opening is shaped substantially similar to and larger than said shape of said first die opening.

18. The apparatus according to claim 17, wherein said second die opening includes an intermediate portion for preshaping the billet before it is extruded through said first die opening, said intermediate portion of said second die opening having a shape which gradually changes from the shape at said upstream end of the second die opening to the shape at said downstream end of said second die opening.

* * * * *